US005307569A

United States Patent [19]

Melcher

[11] Patent Number: 5,307,569

[45] Date of Patent: * May 3, 1994

[54] FOOT SUPPORT

[76] Inventor: Jerald R. Melcher, 9812 Emmett St., Omaha, Nebr. 68134

[ * ] Notice: The portion of the term of this patent subsequent to Dec. 24, 2008 has been disclaimed.

[21] Appl. No.: 809,648

[22] Filed: Dec. 17, 1991

Related U.S. Application Data

[63] Continuation-in-part of Ser. No. 110,456, Oct. 19, 1987, Pat. No. 5,074,059.

[51] Int. Cl.[5] ..... A43B 11/00

[52] U.S. Cl. ..... 36/58.5; 36/50.1

[58] Field of Search ..... 36/50, 58.5, 58.6, 92, 36/170

[56] References Cited

U.S. PATENT DOCUMENTS

| | | | |
|---|---|---|---|
| 201,451 | 3/1878 | Sanford | 36/50 |
| 1,463,531 | 6/1923 | Kennedy | 36/58.6 |
| 1,471,035 | 10/1923 | Keenan | 36/100 |
| 1,763,997 | 6/1930 | Williams | 36/50 |
| 2,096,160 | 10/1937 | Chambers | 36/170 |
| 2,539,761 | 1/1951 | Whitman | 36/170 |
| 3,234,667 | 2/1966 | Bovay | 36/58.5 |
| 3,999,311 | 12/1976 | Epstein | 36/100 |
| 4,236,328 | 12/1980 | Friedlander | 36/58.5 |
| 4,296,558 | 10/1981 | Antonious | 36/50 |
| 4,377,913 | 3/1983 | Stone | 36/50 |
| 4,486,965 | 12/1984 | Friton | 36/50 |
| 5,094,059 | 12/1991 | Melcher | 36/50 |

*Primary Examiner*—Steven N. Meyers

*Attorney, Agent, or Firm*—Vincent L. Carney

[57] ABSTRACT

To support a foot, a special shoe is adapted to receive a flat flexible member having a first fastening means on one end thereof, whereby it may be fastened to a shoe. The shoe has first, second, third and fourth fastening means attached thereto. The second and third fastening means are positioned on opposite sides of the medial plane of the arch of the shoe and are spaced from each other within a range of one-half to four inches; the first and fourth fastening means being positioned within a range of one-eighth to two inches upwardly from a sole and within a range of one-half to three inches of a heel, whereby they are located lower than the arch of the shoe and within a range from the arch of one-half to three inches. The flat flexible member has a second fastening means on a second side, whereby one of said first and second fastening means may be fastened to a shoe over the arch of the foot and the other fastened to a location on the shoe near the sole adjacent to the heel. The strap between said first fastening means and second fastening means has a length of between three inches and eight inches. The first fastening means is a hook and loop fastening means having an area of between three and six square inches.

8 Claims, 4 Drawing Sheets

FOOT SUPPORT

RELATED CASES

This application is a continuation in part of application Ser. No. 07/110,456 filed Oct. 19, 1987, now U.S. Pat. No. 5,074,059.

BACKGROUND OF THE INVENTION

This invention relates to foot supports.

One class of foot support comprises one or more additions to an ordinary shoe that aids in foot comfort and control by restricting the motion of the parts of the foot. Such supports may be removable attachments or permanently attached to the shoe.

In the prior art foot supports of this class, external braces are used or inserts are located in the instep of the shoe to provide support to the arch or the like. Moreover, many shoes have laces to aid in shoe support. However, laces provide support by pulling the shoe more tightly around the foot to create tension in planes that are substantially vertical to the ground and perpendicular to the sole of the foot.

These prior art foot supports have several disadvantages, such as: (1) they do not provide good support for an athlete or an average user of shoes; (2) they do not provide adequate restraint of foot movement during normal use of the foot; (3) they are cumbersome and not easily removed when not in use; (4) they are not readily adjustable to accommodate the individual user; and (5) they do not provide adequate tension in planes forming a diagonal with the sole.

SUMMARY OF THE INVENTION

Accordingly, it is an object of this invention to provide a novel foot support.

It is a further object of the invention to provide a novel foot support which aids in maintaining alignment of a foot when in use.

It is a still further object of the invention to provide a novel foot support which is easily adjustable to the individual user.

It is a still further object of the invention to provide a foot support which may be adjusted to prevent over extension of the foot.

It is a still further object of the invention to provide a foot support that creates tension in a shoe along a plane that makes a diagonal with the sole of the shoe so as to hold the heel of the foot close to the heel of the shoe.

In accordance with the above and further objects of the invention, an adjustable foot pressure adapter is provided which includes first and second sections that cooperate with each other to provide tension between the arch and the sole of a foot at a substantial angle to the sole of the foot. The angle should be between twenty and eighty degrees. The tension is over the arch of the foot and directed to the shoe near the heel to hold the heel and sole of the foot within one-half inch of the inner surface of the heel and sole of the shoe as the foot is moved.

In one embodiment, the foot support includes outside and inside flexible members, such as plastic straps, each having a corresponding one of first and second upper attachment points and first and second lower attachment points. The inside flexible member faces the other foot although it may extend over the arch of the foot to the outside and the outside flexible member faces away from the other foot although it may extend over the arch to face the other foot.

The first attachment point is below the medial longitudinal arch of a foot and the second above the arch on the opposite side of its medial plane. Thus, the pressure is pulled by a strap from the second pressure point to the first over the arch of the foot from a location slightly beyond and backwardly at an angle approximately 75 degrees for the outside member and 60 degrees for the inside member to a plane that is orthogonal to the median plane of the arch.

In the preferred embodiment, the straps are interlaced to permit the fasteners on the straps for the upper fastening points to be on the same side of the straps so both of them contact corresponding fasteners on the shoes at the upper fastening points. The straps also include fasteners adapted to engage corresponding fasteners positioned on either the outer surface or the inner surface of the shoe near or against its sole and heel. The straps may be attached to the shoe at different angles and, in the preferred embodiment, the straps are fastened to the shoe by hook and loop fasteners although any other type of fastener may be used.

In making the pressure adapters, fasteners are attached to the shoe in four locations with two of them near the tongue of the shoe and two near the sole and backwardly at an angle of substantially 60 degrees on the inside section and 75 degrees on the outside section from the two near the tongue. Another member is made to cooperate with the fasteners and that member is flexible and contains two sections. Each section: (1) is movable with respect to the other section; (2) is adapted to be fastened to the shoe at a forward end to one of the fasteners on the shoe and at a rearward end to another of the fasteners on the shoe; and (3) is sufficiently long to stretch over the arch of a shoe, being in the range of three inches to ten inches.

Preferably, a flexible plastic material is formed, such as by die stamping or molding, to have a plurality of parallel fingers spaced from each other. The fastener for the upper fastening point is located on one end and the strap is sufficiently long to extend to a location near the sole after bending over the arch toward the heel at an angle of substantially 75 degrees for the outside flexible member and 60 degrees for the inside flexible member. The outside flexible member and the inside flexible member may be formed using the same die, each having an identical angle (75 degrees or 60 degrees) instead of with different angles, such as in the preferred embodiment, to reduce the cost of the dies. A second fastener for the lower fastening point is located at the other end. Two such straps are fastened together with their fingers interleaved so that the fasteners are all on the same side of the straps to mate with the corresponding fasteners on the shoe.

From the above description, it can be understood that the foot support of this invention has several advantages, such as: (1) it provides protection against over extending movement of the foot; (2) it is useful in maintaining a proper alignment of the foot in use; (3) it may be easily fastened to and used with existing shoes such as with a kit; and (4) it is adjustable to the needs of the individual and the different shaped foot arches of the individual.

SUMMARY OF THE DRAWINGS

The above-noted and other features of the invention will be better understood from the following detailed description when considered with reference to the accompanying drawings, in which.

DETAILED DESCRIPTION

Figure 1:
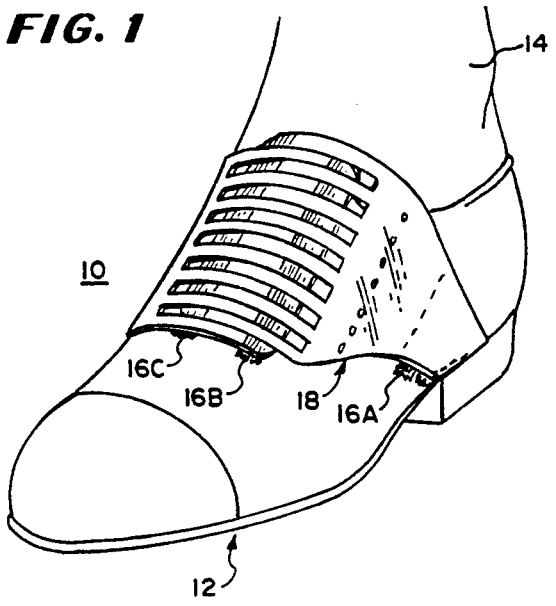
FIG. 1 is a perspective view of a foot support in accordance with an embodiment of the invention.
Figure 2:
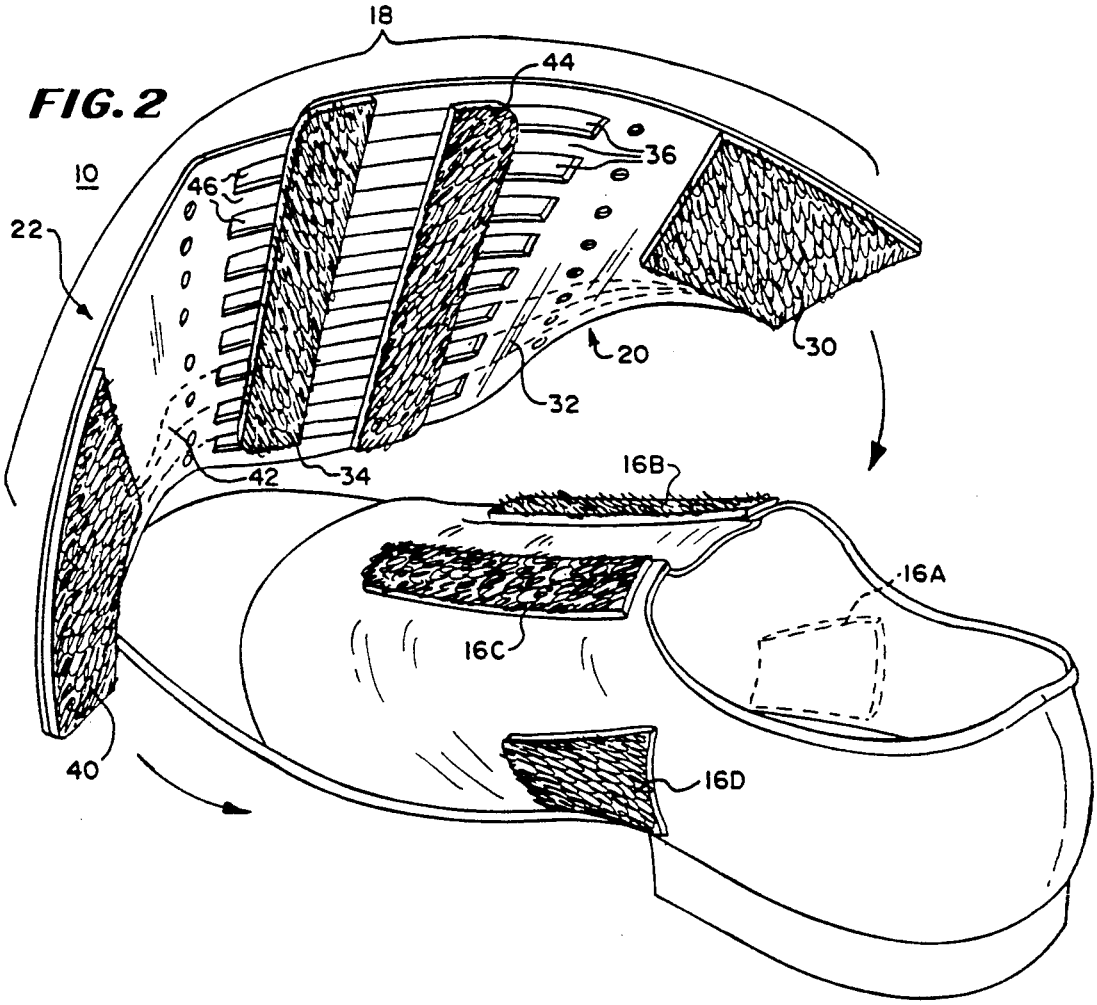
FIG. 2 is an exploded perspective view of the foot support of FIG. 1.

In FIG. 1, there is shown a foot pressure adapter 10 having a shoe 12 worn by a person indicated by the ankle 14, first, second, and third shoe-mounted adapter portions 16A–16C, respectively, of four shoe-mounted adapter portions 16A–16D (16D is shown in FIG. 2 but not FIG. 1) and an adjustable portion 18 of the foot pressure adapter 10.

The shoe 12, the first, second, third and fourth shoe-mounted adapter portions 16A–16D and the adjustable portion 18 cooperate together to provide pressure adjustment of the foot during motion for greater comfort, effectiveness, and freedom from injury, particularly in sports. The fourth shoe-mounted adapter portion 16D is hidden from view in FIG. 1 but its location is shown in FIG. 2.

While a specific shoe 12 is shown in FIG. the invention may be applied to any type of footwear and may be an integral part of the footwear or formed separately or parts of it may be sold separately from the shoe as a kit with the first, second, third and fourth shoe-mounted adapter portions 16A–16D being later attached such as by an adhesive.

The first, second, third and fourth shoe-mounted adapter portions 16A–16D are fasteners for fastening to corresponding parts of the adjustable portion 18 and may be of different types. In the preferred embodiment, the first, second, third and fourth shoe-mounted adapter portions 16A–16D and their corresponding mating portions on the adjustable portion 18 are interlocking fabric members known generically as hook and loop fasteners. In the preferred embodiment, the hook and loop fasteners are of the type sold under the trademark Poly-Lock by Consumer Care located at Sheboygen Falls, Wis. or of the type sold under the trademark Velcro by Velcro U.S.A. Inc. located at Manchester, N.H. but other types of fasteners may be used such as buttons or snap-on fasteners.

Although in the preferred embodiment the upper and lower fastening points are held together by adjustable and removable fastener members, some of the removable fasteners may be replaced by stitching the shoe and strap together. With this arrangement, some flexibility in the adjustability of the foot support is lost when parts of the straps are stitched to the shoe but this embodiment may under some circumstances be desirable. However, there should always be at least one fastener which is removably attachable with its corresponding mating part to permit a foot to be easily inserted and removed. Preferably, the removable fastener is a lower one.

In FIG. 2, there is shown an exploded perspective view of the foot pressure adapter 10, having outside and inside members or sections 20 and 22 which overlap to form a common adjustable portion 18. The outside section 20 is a right-hand section in FIG. 2 and the inside section 22 is a left-hand section in FIG. 2. The outside and inside sections 20 and 22 are designed to cooperate together and, in the preferred embodiment, are designed to be movably fastened together so that the sections are easy to use and yet permit adjustment of pressure on the foot during use. In the embodiment of FIGS. 1 and 2, the shoe laces are not used but shoe laces may be used if desired.

Although the right-hand section 20 and the left-hand section 22, in the preferred embodiment, are fabricated as separate units, they may be one combined unit with the adjustability built in by stretchable members or flexible members which may be, accordion-like, changed in size.

The right-hand section 20 includes a first shoe-adjusting portion 30, a strap portion 32, a second shoe-adjusting portion 34 and a right-left adjusting section 36. Similarly, the left-hand section 22 includes a first shoe-adjusting portion 40, a strap portion 42, a second shoe-adjusting portion 44 and a right-left adjusting section 46. The first and second shoe-adjusting portions 30, 40, 34 and 44, strap portions 32 and 42, and the right-left adjusting portions 36 and 46 serve substantially the same function for opposite sides of a shoe in the right-hand section 20 and left-hand section 22 and are not described separately in their entirety with the understanding that the descriptions of one will, in appropriate cases, be applicable to the descriptions of the other.

The first shoe-adjusting portion 30, the second shoe-adjusting portion 34 and the right-left adjusting section 36 are all attached to a single flexible member and the strap portion 32 is formed in the single flexible member. Similarly, the first shoe-adjusting portion 40, the second shoe-adjusting portion 44 and the right-left adjusting section 46 are attached to a single plastic member and the strap portion 42 is formed in the plastics member.

As best shown in FIG. 2, each of the shoe-mounted adapter portions 16A through 16D receives a corresponding one of the shoe-adjusting portions 30, 44, 34 and 40 to stretch the strap portions 32 and 42 over the arch of the foot from a location near the heel of the shoe to a location near the tongue of the shoe on the opposite side of the arch of the foot. With this structure, the right-hand and left-hand adjustment portions 20 and 22 work together to form supports which are adjustable in position and extend over the arch and then downwardly to the bottom of the arch.

The adjustable portion 18 is completely removable and replaceable and adjustable at four locations to accommodate the particular support that is needed. However, if desired, fewer than all four of the shoe-adjusting portions need be removable so that the sides of the shoe can be spread to insert a foot with the others remaining permanently in place. Moreover, instead of hook and loop fasteners, other materials, such as buttons or hooks, may be used to fasten the members in place.

Figure 3:
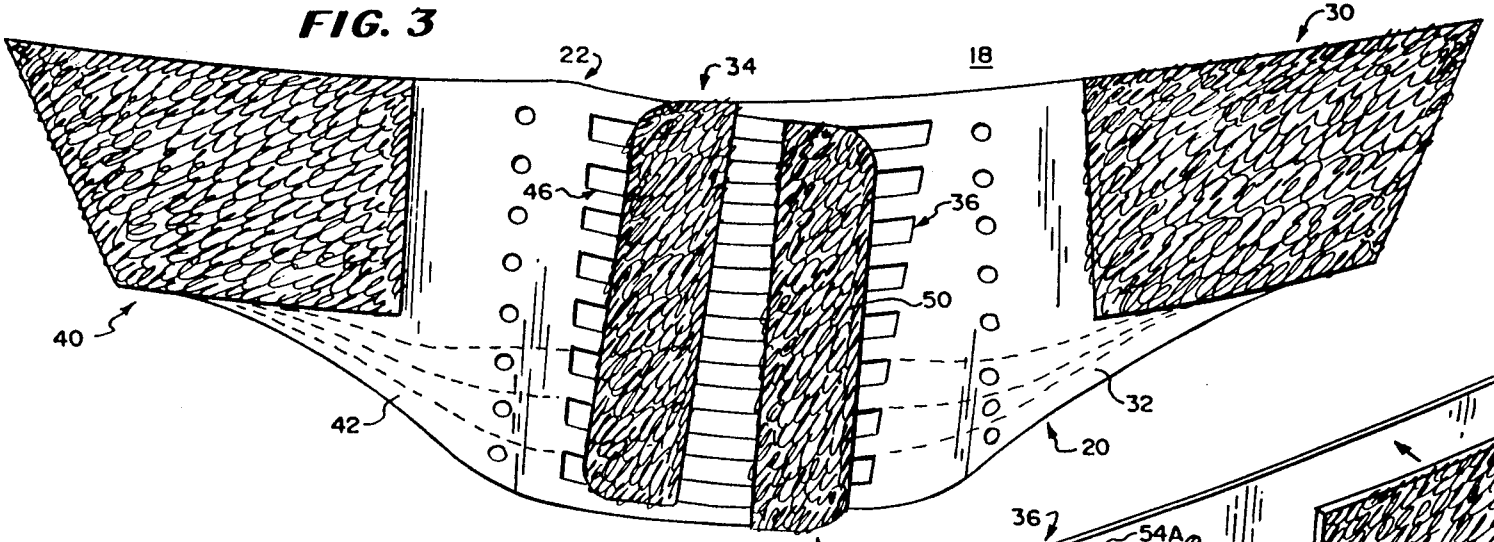
FIG. 3 is a bottom view of a portion of the foot support of FIG. 1.

In FIG. 3, there is shown a bottom view of the right-hand and the left-hand sections 20 and 22 of the adjustable portion 18 (FIGS. 1 and 2) of the foot pressure adapter 10 (FIGS. 1 and 2) having from left to right as shown in FIG. 2, the left-hand first shoe-adjusting portion 40, the left-hand strap portion 42, the right-left adjusting portion 46, the right-hand second shoe-adjusting portion 34, the left-hand second shoe-adjusting portion 44, the right-left adjusting portion 36, the right-hand strap portion 32, and the right-hand first shoe-adjusting portion 30.

The right-left adjusting sections 36 and 46 each contain fingers which are interleaved with the fingers of the other right-left adjusting section. This interlocking relationship of the right-hand and left-hand sections 20 and 22 permit both the right-hand and left-hand first shoe-adjusting portions 30 and 40 to be positioned on the bottom of the adjustable portion 18 and adjacent to each other and both the right-hand and left-hand second shoe adjusting portions 34 and 44 to be positioned on the bottom of the adjusting portion 18 at the left and right extremes of the adjustable portion 18. Thus all four of the shoe adjusting portions 40, 34, 44, and 30 face in the same direction and downwardly.

To adjustably fasten the second shoe-adjusting portion 44 to the second shoe mounted adapter portion 16B (FIG. 2), the second shoe-adjusting portion 44 is a hook and loop fastening member 50 attached to the right-left adjusting section 46 such as by an adhesive to form a single unit therewith.

To permit easy adjustment, the underside of the bottom hook and loop fastening member 50 is adapted to engage the second shoe mounted adapter portion 16B (FIG. 2) in any of a plurality of positions. With this arrangement, the adjustable portion 18 and the shoe-mounted adapter portions 16A–16D may be fastened in any of angular positions with respect to each other or may be directly aligned and may be offset slightly to only partly overlap or more fully coincide depending on the user's comfort.

Figure 4:
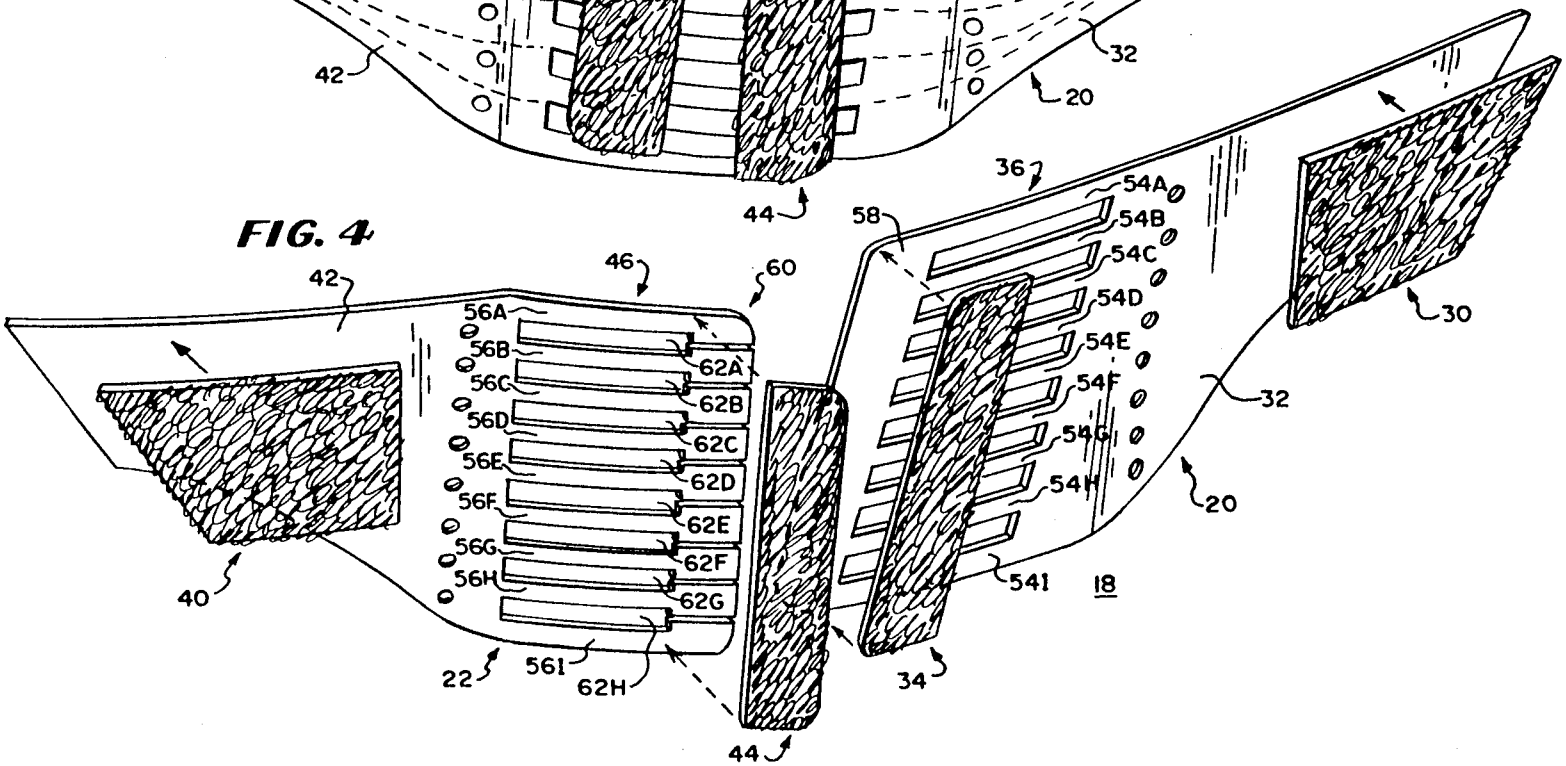
FIG. 4 is an exploded perspective view of the portion of the foot support shown in FIG. 3.

In FIG. 4, there is shown an exploded perspective view of the adjustable portion 18 illustrating one method of forming the interlocking relationship between the outside and inside sections 20 and 22. As shown in the view, the right-left adjustment sections 36 and 46 each include a different one of the two sets of fingers 54A–54I and 56A–56I respectively. The individual fingers of each set of fingers is spaced from adjacent fingers by apertures to receive the other set of fingers in an interlocking relationship.

In the preferred embodiment, the two sets of fingers are integrally formed with corresponding ones of the right-hand strap portion 32 and the left-hand strap portion 42, each being cut from a single flexible plastic member to be able to bend around a shoe to provide support thereto. Each of the plurality of fingers 54A–54I and each of the plurality of fingers 56A–56I are spaced from the adjacent fingers in the same set a sufficient distance to permit fingers of the opposite set to fit between them in an interlaced fashion so that the right-hand and left-hand sections 20 and 22 are adjustably connected with the right-left adjustment sections 36 and 46 and strap portions 32 and 42 overlapping.

In the preferred embodiment, the fingers are formed by cutting slots in a single piece of plastic, leaving a section at the end. The right-hand right-left adjustment section 36 has an integrally formed end section 58 to which the second shoe adjustment portion 34 is attached and the left hand right-left adjustment section 46 has an integrally formed end section 60 to which the second shoe adjustment portion 44 is attached. One of the end sections, which in the illustrated embodiment is the end section 60, includes a plurality of slots 62A–62H connecting the slots between corresponding ones of the fingers 56A–56I to permit the fingers 56A–56I to be separated for insertion between the fingers 54A–54I. The second shoe adjusting portion 44 closes these slots in the end section 60 to hold the right and left hand sections 20 and 22 together.

With this arrangement, the second shoe-adjusting portion 44 (FIGS. 2, 3 and 4) is fastened to the second shoe mounted adapter portion 16B (FIG. 2) slightly beyond the median of the arch of a foot and the strap portion 42 pulled over the median of the arch and downwardly so that the left-hand first adjusting portion 40 (FIGS. 2, 3 and 4) is fastened at a location inwardly and close to the side of the arch. A similar member overlaps and exerts the same type of pressure on the opposite side of the foot with the pressure adjustment members being adjustable in an angle to change the direction of the pressure as the foot is articulated.

To make a foot pressure adapter 10, the shoe mounted portions 16A–16D (FIGS. 1 and 2) may be sewn in place or, if it is desirable to utilize a kit, adhesive may be used to position the hook and loop. The area of the hook and loop must be sufficient to provide holding power and support in the use of the shoe and have enough area to permit positioning at different angles. The area of the shoe mounted portions 16B and 16C (FIGS. 1 and 2) at the top fastening position should be between one and ten square inches and the corresponding hook and loop section of the adjustable portions 44 and 34 (FIGS. 2, 3 and 4) should have an area within the corresponding range but not necessarily the same area. The areas are chosen to permit partial overlapping but also to permit at least one square inch of engaging surfaces. The area of the hook and loop fastening members in the lower fastening position should be in a similar range of areas.

To fabricate the adjustable portion of the foot pressure adapter, in the preferred embodiment, strips are cut out or molded of strong flexible plastic and the hook and loop or other fasteners are fastened in place.

To form the interlaced section, open fingers such as the plurality of fingers 54A–54I (FIG. 4) are cut with spaces between them sufficiently wide to accommodate the fingers of the mating member so that the right and left-hand portions 20 and 22 (FIGS. 2, 3 and 4) may be interlaced to expose their fastening members on the bottom side. The second pressure members may be utilized to close the ends of the plurality of fingers shown at 54A–54I and the corresponding parts on its mating member such as by adhesive or heat sealing or solvent sealing or stitching or the like.

Figure 5:
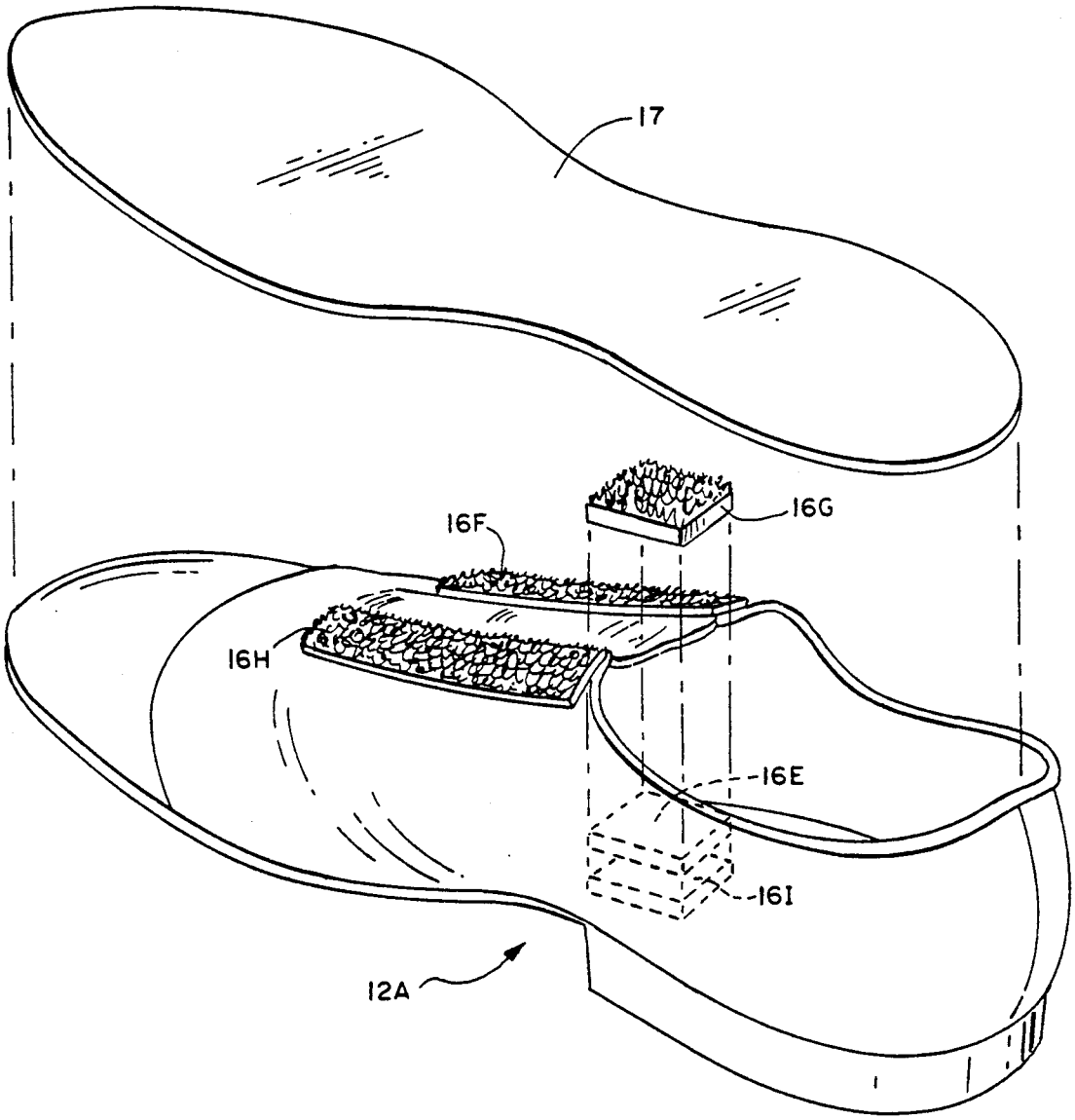
FIG. 5 is an exploded perspective view of a portion of another embodiment of foot support.
Figure 6:
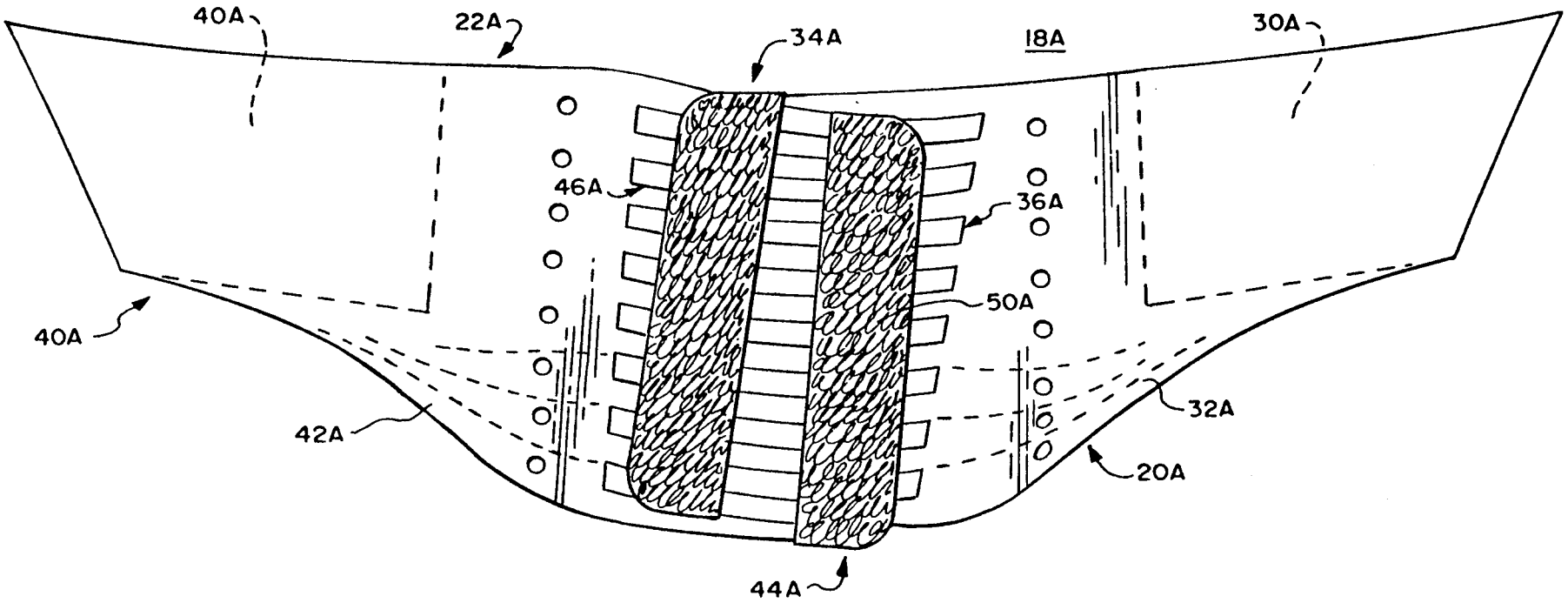
FIG. 6 is a bottom view of another portion of the embodiment of FIG. 5.

In FIGS. 5 and 6, there are shown an exploded perspective view and a bottom view of another embodiment of the foot pressure adapter, similar to the foot pressure adapter 10 and made in the same manner except that one end of each adjustable member (referred to in the embodiment of FIGS. 5 and 6 by the reference numeral 18A) is connected to the inside surface of the shoe or under the insole 17 so that it is above the shank of the shoe and under the medial longitudinal arch of the foot instead of being on the outside surface of the shoe.

In FIG. 5, there is shown a portion of a foot pressure adapter having a shoe 12A, first, second, third and fourth shoe-mounted adapter portions 16E–16H, and the insole 17 of the shoe respectively. The shoe-mounted portion 16G and insole 17 are exploded away for illustration but the shoe mounted portion 16G is actually fastened at 16I under the insole 17 in the preferred embodiment for comfort of the user although the shoe mounted portions 16E and 16G can be mounted above the insole 17 instead of below it. A corresponding adjustable portion 18A of this embodiment of foot pressure adapter is shown in FIG. 6.

The shoe 12A, the first, second, third and fourth shoe-mounted adapter portions 16E–16H and the adjustable member 18A are directly analogous to the correspondingly numbered parts of the embodiment of FIGS. 1–4 and cooperate together in the same manner to provide pressure adjustment of the foot during motion for greater comfort, effectiveness, and freedom from injury, particularly in sports. However, the adapter portions 16E–16H and adjustable member 18A are adapted to mount to the inside surface of the shoe 12A.

In FIG. 6, there is shown a bottom view of the foot pressure adapter of the common adjustable portion 18A having outside and inside members or sections 20A and 22A ,which overlap. The outside and inside members 20A and 22A of the common adjustable portion 18A are substantially the same as the outside and inside members 20 and 22 of common adjustable portion 18 of the embodiments of FIGS. 1–4 except that the shoe adjusting portions 40A and 30A face in the opposite directions and are on opposite sides of the flexible strips forming the adjustable portion 18A from the shoe adjusting portions 34A and 44A in the embodiment of FIGS. 5 and 6 instead of all of the shoe adjusting portions facing in the same direction and being attached to the same side of the flexible strips of the common adjustable portion as is the case with the shoe adjusting portions 40, 34, 44, and 30 in the embodiment of FIGS. 1–4.

The reason the shoe adjusting portions 40A and 30A face in the opposite directions and are on opposite sides of the flexible strips forming the support for the entire adjustable portion 18A from the shoe adjusting portions 34A and 44A, is that the shoe adjusting portions 40A and 30A are mounted to an inside surface of the shoe 12A. Thus, the shoe adjusting portions 34A and 44A fit outside of the shoe 12A and are fastened to the shoe mounted adjustable portions 16H and 16F (FIG. 5) and the shoe adjusting portions 40A and 30A extend inside the shoe and are fastened to the shoe-mounted adjusting portions 16E and 16G. For this purpose, the shoe adjusting portions 40A and 30A face the opposite surface of the flexible backing member from the shoe adjusting portions 34A and 44A.

To provide support to a foot, the foot pressure adapter 10 is positioned to maintain the foot in proper alignment and reduce over extension. When in use, as the foot is being articulated, it is held in a pre-selected manner by the foot support 10 to: (1) keep the foot aligned; and (2) prevent over supination and over pronation.

To adjust the foot pressure adapter 10, the user attaches the adjustable portion 18 or the adjustable portion 18A to the shoe. The adjustable portion 18 is adjusted by the user after putting the shoe on his or her foot. In attaching the adjustable portion 18, the second shoe-adjusting portions 34 and 44 (FIGS. 2, 3 and 4) are first positioned on the corresponding second and third shoe-mounted adapter portions 16B and 16C (FIG. 2).

In positioning the second shoe-adjusting portions 34 and 44 (FIGS. 2, 3 and 4) on the corresponding second and third shoe-mounted adapter portions 16B and 16C (FIG. 2), an angle is selected along the direction of the medial foot arch. With this angle, the second adjustment portions 34 and 44 may slant together at the lower part of the arch and apart at the top or the reverse of this angular direction and may make any of a plurality of angles with respect to each other to accommodate different directions and amounts of support along a portion of the arch.

After the second shoe-adjusting portions 34 and 44 (FIGS. 2, 3 and 4) have been positioned and fastened to the second and third shoe mounted adapter portions 16B and 16C (FIG. 2), the right and left-hand first shoe-adjusting portions 30 and 40 (FIGS. 2, 3 and 4) are pulled backwardly and fastened to the the first and fourth shoe mounted adapter portions 16A and 16D (FIG. 2) to provide the desired amount of support. This amount can be tested by articulating the foot to be sure that resistance is provided when the foot is articulated to its useful extremes to prevent over extending the foot. The angle of motion can be controlled by adjusting the pressure and some guidance can be provided by the appearance of the heel of the shoe so that an adjustment may be made which compensates for wear on the outer or inner edges of the heel indicating unaligned movement.

In attaching the adjustable portion 18A, the first shoe adjusting portions 30A and 40A are attached to the corresponding third and fourth shoe mounted adapter portions 16G and 16E under the insole. The user then puts the shoe on his or her foot and selects an angle for the attachment of the second shoe adjusting portions 34A and 44A to the first and second shoe mounted adapter portions 16F and 16H to provide maximum comfort as in the embodiment 18.

Thus, the support exerts more pressure in some areas than others to accommodate sore spots and to provide adequate support for different shaped arches. Generally, this pressure is applied through the flexible member over the arch in both directions and downwardly at an angle to a plane perpendicular to the medial plane of the arch and making a 75 degree solid angle outside and 60 degree solid angle inside with respect to the orthogonal plane.

The purpose of the adjustable shoe is to turn the uppermost point of the arch to redistribute the weight on the bottom of the foot by changing the shape of the shoe to accommodate the needs of the individual. The foot in accommodating the adjusted shape of the shoe redistributes the weight to the outside of the foot to correct pronation or redistributes the weight to the inside of the foot to correct supination. To change the shape of the shoe when running, as much of the perimeter surface as possible is engaged by the flexible members.

From the above description, it can be understood that the foot support of this invention has several advantages, such as: (1) it provides protection against over extending movement of the foot; (2) it is useful in maintaining a proper alignment of the foot in use; (3) it may be easily fastened to and used with existing shoes such as with a kit; and (4) it is adjustable to the needs of the individual and the different shaped foot arches of the individual.

Although a preferred embodiment of the embodiment has been described with some particularity, many modifications and variations in the invention are possible within light of the above teachings. Therefore, it is to be understood that, within the scope of the appended claims, the invention may be practiced other than as specifically described.

I claim:

1. A kit of articles comprising:

adjustable means for applying tension to a foot between a location near the underside of a medial longitudinal arch of the foot and a location near a sole of the foot at an angle in the range of between 20 degrees to a sole of a shoe and 80 degrees to the sole of the shoe wherein tension is directed over the medial arch of the foot and downwardly to a bottom of the medial arch of the foot to hold a heel of the foot within one-half inch of an inner surface of the heel of the shoe and to hold the sole of the foot within one-half inch of an inner surface of the sole of the shoe as the foot is moved;

said adjustable means including a flat flexible member;

said flat flexible member having at least one fastening means on one end, whereby it may be fastened at a location to apply said tension;

an adhesive member;

said adhesive member being adapted to fasten shoe mounting portions to the shoe, whereby said kit may be utilized to form a shoe suitable for use with a foot support whereby as the foot is articulated, the foot is kept aligned and prevented from over supination and over pronation.

2. A kit according to claim 1 in which:

said flat flexible member includes a first fastening means on one end thereof, whereby it may be fastened to the shoe;

said flat flexible member having a second fastening means on a second side, whereby one of said first and second fastening means may be fastened to the shoe over the arch of the foot and the other fastened to a location on the shoe near the sole adjacent to the heel; and said flat flexible member having a length of between three inches and eight inches between said first fastening means and said second fastening means.

3. A kit in accordance with claim 2 in which said first fastening means is a hook and loop fastening means and has an area of between one and ten square inches.

4. A kit in accordance with claim 3 further including:

a second flat flexible member;

said second flat flexible member being movably connected to said first-mentioned flat flexible member;

a third fastening means on one end of said second flat flexible member;

a fourth fastening means on a second end of said second flat flexible member;

said first-mentioned flat flexible member and said second flat flexible member having a top and a bottom and said bottoms of said first-mentioned flat flexible member and said second flat flexible member facing in the same direction.

5. An article of manufacture comprising:

adjustable means for applying tension to a foot between a location near the underside of a medial longitudinal arch of the foot and a location near a sole of the foot at an angle to a sole of a shoe wherein tension is directed over the medial arch of the foot and downwardly to a bottom of the medial arch of the foot to change the shape of the shoe so a user corrects for at least one of over pronation and over supination;

said adjustable means including at least one flat flexible member;

said flat flexible member including a first fastening means on one end thereof, whereby it may be fastened to the shoe at a location to apply said tension;

said flat flexible member having a second fastening means on a second end wherein one of said first and second fastening means may be fastened to the shoe over the arch of the foot and the other fastened to a location on the shoe selected to be near the sole of the shoe wherein the shoe is changed in shape to cause a user to correct for said over supination and over pronation; and said flat flexible member having a length of between three inches and eight inches between said first fastening means and said second fastening means whereby as the foot is articulated, the user aligns the foot and prevents over supination and over pronation.

6. An article of manufacture comprising:

adjustable means for applying tension to a foot between a location near the underside of a medial longitudinal arch of the foot and a location near a sole of the foot at an angle in the range of between 20 degrees to a sole of a shoe and 80 degrees to the sole of the shoe wherein tension is directed over the medial arch of the foot and downwardly to a bottom of the medial arch of the foot to change the shape of the shoe such that a user corrects for one of over pronation and under pronation as the foot is moved;

said adjustable means including a first flat flexible member;

said flat flexible member having at least one fastening means on one end, whereby it may be fastened to the shoe at a location to apply said tension;

a second flat flexible member;

said second flat flexible member being movable connected to said first flat flexible member;

a third fastening means on one end of said second flat flexible member; and a fourth fastening means on a second end of said second flat flexible member;

said first flat flexible member and said second flat flexible member having a top and a bottom, whereby as the foot is articulated, the foot is kept aligned and prevented from over supination and over pronation.

7. A kit of articles comprising:

adjustable means for applying tension to a foot between a location near the underside of a medial longitudinal arch of the foot and a location near a sole of the foot at an angle in the range of between 20 degrees to a sole of a shoe and 80 degrees to the sole of the shoe wherein tension is directed over the medial arch of the foot and downwardly to a bottom of the medial arch of the foot to change the shape of the shoe to compensate for one of over pronation or over supination;

said adjustable means including at least one flexible member adapted to be fastened to the shoe;

said flat flexible member having at least one fastening means on one end, whereby it may be fastened at a location to apply said tension; and an adhesive member;

said adhesive member being adapted to fasten shoe mounting portions to the shoe, whereby said kit may be utilized to form a shoe suitable for use with a foot support, whereby as the foot is articulated, the user aligns the foot and prevents over supination and over pronation.

8. A method of making a foot support comprising the steps of:

forming a flat flexible strap means having a length of between five and ten inches;

attaching a first fastening means to one end of said strap means; and attaching a second fastening means to a second end of said strap means;

the step of forming the flat flexible strap means including the substeps of: forming a first flexible member having a plurality of slots and at least one fastening means; forming a second flexible member having a plurality of slots and at least one fastening means; interlacing said plurality of slots of said first and second flexible members so that said first and second fastening means are on a same side of said strap means; fastening one of the ends of said first and second flexible members at a location on the shoe; stretching the flexible members over an arch of a foot to a location on the medial arch wherein an adjustable means is formed for applying tension to the foot between the upper side of the arch of the foot and a location near a sole of the foot at an angle in the range of between 20 degrees to a sole of the shoe and 80 degrees to the sole of the shoe such that tension is directed over the medial arch of the foot and downwardly to a bottom of the medial arch of the foot to change the shape of the shoe and cause a wearer to correct for over pronation and over supination.

* * * * *